United States Patent [19]

Robinet

[11] 4,331,110

[45] May 25, 1982

[54] PRIMING AND STARTING APPARATUS FOR ENGINES

[76] Inventor: Norman A. Robinet, 404-6505 Huntridge Hill, NE., Calgary, Alberta, Canada, T2K 5E5

[21] Appl. No.: 740,085

[22] Filed: Nov. 9, 1976

[51] Int. Cl.[3] ..... F02N 3/02

[52] U.S. Cl. ..... 123/185 A; 123/185 D; 123/187.5 R

[58] Field of Search ..... 123/185 R, 185 A, 185 D, 123/187.5 R, DIG. 3; 74/625; 46/78

[56] References Cited

U.S. PATENT DOCUMENTS

| | | | |
|---|---|---|---|
| 1,182,531 | 5/1916 | Doman | 123/185 |
| 1,189,067 | 6/1916 | Davenport | 123/185 A |
| 1,622,289 | 3/1927 | Nelson | 123/185 D |
| 2,385,963 | 10/1945 | Beard | 123/185 |
| 2,448,844 | 9/1948 | Throsel | 123/185 D |
| 2,526,578 | 10/1950 | Righter | 123/185 |
| 2,625,143 | 1/1953 | Demitz | 123/185 |
| 2,700,968 | 2/1955 | McElroy | 123/185 D |
| 2,927,660 | 3/1960 | De Grout | 123/185 D |
| 3,094,109 | 6/1963 | Effinger, Jr. | 123/DIG. 3 |
| 3,716,039 | 2/1973 | Perry | 123/185 A |

OTHER PUBLICATIONS

Cox Pt-19, Flight Trainer Manual, pp. 1,6,7,8, L. M. Lex Manufacturing Co., 1974.

*Primary Examiner*—Charles J. Myhre
*Assistant Examiner*—Andrew M. Dolinar
*Attorney, Agent, or Firm*—Finnegan, Henderson, Farabow, Garrett & Dunner

[57] ABSTRACT

Disclosed are apparatus and methods for priming and starting a two-cycle engine. A spool is drivingly coupled to the engine crankshaft. The intermediate portion of a cord is wrapped at least once about the spool leaving opposite ends of the cord free. To prime the engine, the opposite ends of the cord are grasped and alternately pulled causing rotation of the spool and crankshaft in corresponding alternate angular directions. To start the engine, one cord end is released and the opposite cord end is pulled to impart unidirectional angular rotation to the engine crankshaft and remove the cord from the spool. In one form hereof, the spool is located in driving relation to the crankshaft between the power takeoff, i.e. a propeller, and engine. In another form, the spool is formed as an integral portion of the propeller on the side of the propeller remote from the crankshaft.

6 Claims, 7 Drawing Figures

PRIMING AND STARTING APPARATUS FOR ENGINES

The present invention relates to apparatus and methods for priming and starting an engine and particularly relates to apparatus and methods for priming and starting a two-cycle engine, such as a gasoline powered model airplane engine.

One very old but still used method for starting an engine, for example a gasoline powered model airplane engine, is to manually rotate the propeller by flipping the propeller blade with a finger until the engine starts. This method is slow, tedious and can result in injury to the individual's finger if the engine should backfire or start unexpectedly. Many mechanical devices for starting an engine of this type have been proposed and constructed in the past. Certain of these devices act on and cooperate with the propeller and/or propeller hub of the model airplane engine. Such devices are conventionally not an integral part of the propeller or engine but rather constitute a separate item of equipment. These primarily comprise spring-wound or otherwise powered hand held devices for external attachment to the propeller to rotate it one or more revolutions. The devices are then disengaged or automatically disengaged from the propeller when the engine starts. An example of such device is described and illustrated in U.S. Pat. No. 2,700,968 issued Feb. 1, 1955 entitled "Model Aeroplane Motor Starter".

Existing starter devices have also included a starting spool. In such devices, one end of a cord is secured to the starting spool and the cord is substantially fully wrapped about the spool leaving only the opposite end of the cord free. The free end of the cord is then pulled in a rip-cord or unwinding manner with resultant unidirectional rotary motion imparted to the engine crankshaft.

Prior conventional methods for priming the engine include squirting fuel directly into the cylinder in order to enable the engine to fire once or twice and thereby draw additional fuel through the fuel line into the engine. This method of priming is slow, clumsy and oftentimes hazardous particularly is fuel is spilled about the outside of the engine. Also, there is considerable time lapse between priming and starting using such conventional methods. This is caused by the necessity to apply the starting equipment to the propeller and crankshaft after priming. This time lapse often permits fuel evaporation resulting in ineffective priming with delayed starting.

The present invention provides a primer-starter device for engines which minimizes or eliminates the foregoing and other problems associated with prior apparatus and methods for priming and starting engines and provides novel and improved apparatus and methods for priming and starting engines having various advantages in construction, operation and use in comparison therewith. Particularly, the present invention provides novel and improved methods and apparatus for priming and starting a two-cycle engine. More particularly, the apparatus of the present invention includes a cylindrical element or spool drivingly connected to the crankshaft or power takeoff, i.e. the propeller, of the engine. In one form, the spool is formed integrally with the propeller and projects forwardly thereof on the side of the propeller remote from the crankshaft terminating in a free flanged end. In another form, the cylindrical element or spool is drivingly coupled to the crankshaft between the power takeoff, i.e. the propeller, and the engine. A cord is provided and an intermediate portion of the cord is wrapped at least once, and preferably no more than two times, about the spool leaving the opposite ends of the cord free.

In accordance with the method of the present invention, the engine is primed by alternately pulling the opposite free ends of the cord causing rotation of the spool and crankshaft in corresponding alternate angular directions. The reciprocating action of the priming method hereof draws fuel from the fuel tank through the fuel line into the engine without the prior necessity of externally applying fuel to the engine. The priming continues upon continued reciprocation of the cord and crankshaft in an evenly applied manner until the engine is fully primed. Once primed, a loose end of the cord is pulled in rip-cord fashion to rotate the crankshaft unidirectionally while the other loose end is brought up into the one or two loops about the spool. That is, the loose or released end is pulled into and about the starter spool by pulling the other free end of the cord away from the spool with the result that, upon starting, the cord is totally unwound from the spool. In contrast to prior rip-cord starting devices, the present invention requires only one or two loops of the cord to be wrapped about the starting spool intermediate its free ends. The cord is otherwise free of the spool.

Various advantages accrue to the primer-starter device of the present invention in that there is practically instantaneous switch-over from the primary action to the starting action. No loss of fuel through evaporation occurs and the switch-over is accomplished at a time chosen by the individual starting the engine. Moreover, the spool on the propeller or crankshaft may be formed of heavy material to posses flywheel characteristics. The spool, when acting as a flywheel and after starting, tends to store energy during engine power strokes and releases energy during the rest of the engine cycle thereby contributing to smoother engine running, lower possible engine r.p.m. and easier engine starting.

Accordingly, it is a primary object of the present invention to provide novel and improved methods and apparatus for starting engines.

It is another object of the present invention to provide novel and improved methods and apparatus for priming and starting two-cycle engines wherein priming is accomplished without external application of fuel.

It is still another object of the present invention to provide novel and improved methods and apparatus for starting engines wherein the apparatus forms an integral part of the engine or propeller and imparts flywheel characteristics to the engine.

It is a further object of the present invention to provide novel and improved methods and apparatus for priming and starting an engine wherein instantaneous switch-over from priming to starting is accomplished.

It is a still further object of the present invention to provide a novel and improved primer-starter device for engines which is inexpensive to construct, simple and easily utilized, and has improved safety characteristics.

Additional objects and advantages of the present invention will be set forth in part in the description which follows and in part will be obvious from the description, or may be learned by practise of the invention. The objects and advantages of the invention may be realized and attained by means of the insrumentalities and combinations particularly pointed out in the appended claims.

To achieve the foregoing objects and in accordance with the purpose of the invention, as embodied and broadly described herein, the priming apparatus of the present invention comprises a crankshaft, an engine drivingly coupled to the crankshaft, a propeller carried by the crankshaft, means for priming the engine including a cylindrical element or spool forming an integral portion of the propeller and projecting on the side of the propeller opposite the crankshaft, the cylindrical element or spool having a free end remote from the propeller and a groove between the free end and the propeller, and a cord having opposite free ends with an intermediate portion wrapped at least once about the spool whereupon alternate pulling of the free ends of the cord causes rotation of the spool, crankshaft and propeller in corresponding alternate angular directions to prime the engine. To start the engine, one end of the cord is released and its opposite end is pulled to rotate the crankshaft unidirectionally to start the engine.

To further achieve the foregoing objects and in accordance with the present invention, a method of priming the engine includes the steps of wrapping a cord about the cylindrical element at least one full turn leaving the opposite end of the cord free and alternately pulling the free ends of the cord to jointly rotate the element and crankshaft in corresponding alternate angular directions to prime the engine. Preferably, after priming, the one free end of the cord is released. The opposite free end of the cord is then pulled to impart rotation to the element and the crankshaft to start the engine and remove the cord from the element.

The accompanying drawings illustrate plural embodiments of the present invention and, together with the description, serve to explain the principles of the invention.

IN THE DRAWINGS

Figure 1:
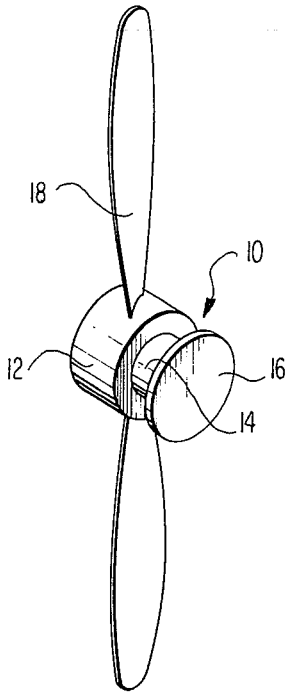
FIG. 1 is a perspective view of a part of a priming and starting apparatus constructed in accordance with the present invention and illustrating it in conjunction with a propeller blade.
Figure 3:
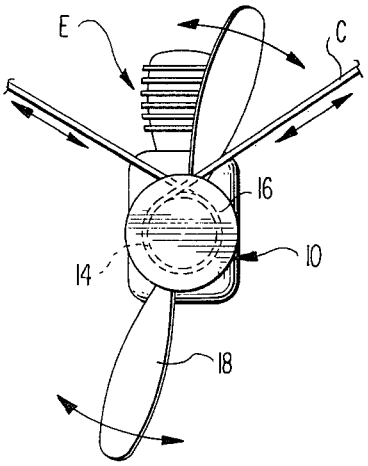
FIG. 3 is a front elevational view illustrating a method of priming an engine in accordance with the present invention.

Referring now to the specifically disclosed embodiments of the present invention and particularly to FIG. 1, there is illustrated a primer-starter device for engines including a cylindrical element or spool generally designated 10 in driving relation with the crankshaft 11 (FIG. 4) of an engine generally designated E (FIG. 3). In the form of the invention illustrated in FIG. 1, cylindrical element 10 includes a hub 12 having a forwardly projecting reduced diameter cylindrical shaft 14 terminating at its forward end in a diametrically enlarged annular rim or flange 16. In this form, propeller blades 18 are integrally formed with spool 10 and project radially outwardly from hub 12. The propeller and spool may be formed of an integrally molded plastic material.

Figure 4:
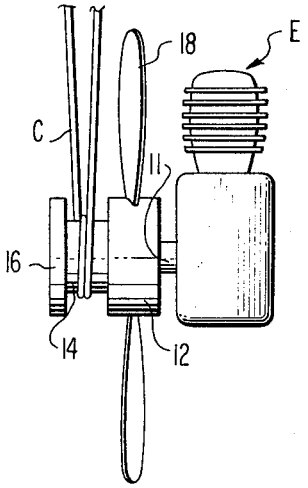
FIG. 4 is a side elevational view thereof.

Referring now to FIGS. 3 and 4, the means for priming and starting the engine E including spool 10 also include a cord C. Cord C is wrapped about the reduced diameter shaft 14 at least once and preferably no more than two times leaving opposite ends of the cord free. It will be appreciated that reduced diameter shaft 14 projects forwardly of propeller 18 and this facilitates wrap of cord C about shaft 14. Preferably, this initial wrap is provided intermediate the ends of the cord whereby both ends of the cord project freely to opposite sides of the shaft 14.

In accordance with the method of the present invention, the engine is first primed by alternately pulling the opposite free ends of the cord in a reciprocating action, for example in the direction of the arrows shown in FIG. 3. More specifically, one end of the cord is pulled in a direction away from the shaft while the opposite end of the cord is held taut and drawn into the spool. When the latter end is drawn substantially close to the shaft 14, the motion is reversed. That is, the end previously held taut is pulled away from shaft 14 and the opposite end, previously pulled, is held taut as it is drawn into or toward shaft 14 to maintain the frictional engagement between the cord and the reduced diameter shaft. It is important to hold one end of the cord taut while the other end is pulled such that frictional engagement between the cord and the reduced diameter shaft 14 is maintained.

Thus, by alternately pulling opposite free ends of cord C while maintaining the other ends taut, rotation of the spool and crankshaft in corresponding alternate angular directions is accomplished. It will be appreciated that engine E is of the two-cycle type. This angular reciprocating action provided to the engine crankshaft draws fuel from the fuel tank, not shown, through the fuel line into the engine upon each stroke and thus primes the engine.

Figure 5:
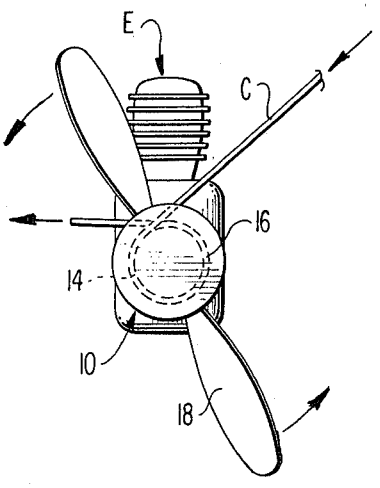
FIG. 5 is a front elevational view similar to FIG. 3 but illustrating the method of starting the engine.

Referring now to FIG. 5, the engine is easily started by continuing the motion used in priming the engine but releasing the long end of the cord while the other end is pulled. That is, the short end of the cord, i.e. the cord end closest to the shaft 14, is pulled unidirectionally in-rip cord fashion to rotate the propeller 18, hub 12 and crankshaft 11 unidirectionally. The loose or relased end of the cord is thus drawn toward and brought up into the one or two loops about the spool. The quick pulling of the cord in rip-cord fashion enables continued frictional engagement of the cord and reduced diameter shaft 14 whereby the shaft is rotated unidirectionally to start the engine. Note that it is a particular feature of the present invention that the starting of the engine follows closely in time with the priming of the engine. Thus priming fuel is not lost through evaporation while awaiting engine start-up.

Importantly, equipment external to the engine as in prior conventional starting devices need not be removed after the engine has been started since the primary component of the primer and starter device hereof, i.e. spool 10, is formed integrally with the engine. Only the cord is removed and that removal occurs upon and as a part of the engine starting action. Also, spool 10 may be formed of a very heavy material whereby a flywheel effect can be provided. Energy can be stored in the flywheel during engine power strokes and released during the rest of the engine cycle thereby contributing to smoother engine running and easier engine starting.

Figure 6:
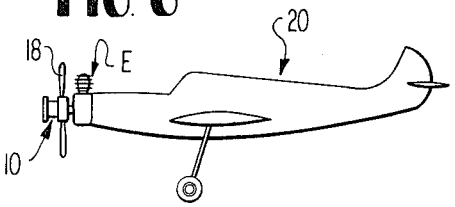
FIG. 6 is a side elevational view of a model airplane having an engine and a primer and starter apparatus in accordance with the present invention.

Referring to FIG. 6, there is illustrated a model airplane generally designated 20 in which the engine E, propeller 18 and priming and starting spool 10 are mounted. It will readily be appreciated that the shaft 14 projects forwardly of the propeller thus facilitating wrap of the cord about the priming and staring device hereof.

Figure 2:
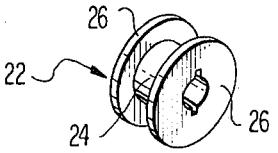
FIG. 2 is a perspective view of a portion of the priming and starting apparatus according to another embodiment of the present invention.
Figure 7:
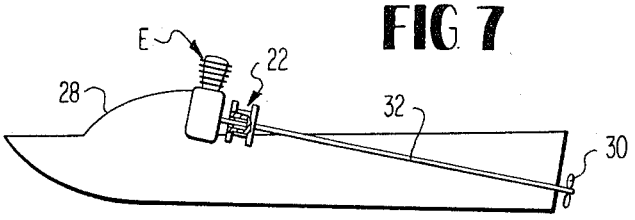
FIG. 7 is a schematic side elevational view of the priming and starting apparatus for the present invention interposed between the engine and the propeller.

Referring now to FIGS. 2 and 7, there is illustrated a cylindrical element or spool generally designated 22 having a reduced diameter shaft 24 and rims or flanges 26 at opposite ends thereof. The interior of spool 22 may be provided with a keyway 26 or equivalent device for cooperation with a corresponding key or equivalent device on a crankshaft. The spool 22 illustrated in FIG. 2 is useful in priming and starting engines in those environments where the primer and starter device can be more effectively disposed between the engine and power takeoff. For example, in FIG. 7 the engine E is disposed in a forward portion of the model boat schematically illustrated at 28. The propeller 30 illustrated at the aft end of the boat is coupled to the engine through a drive shaft 32. Spool 22 may be keyed to and form a part of the drive shaft 32 between engine E and the power takeoff or propeller 30.

The engine E in FIG. 7 is primed and started similarly as previously described. In this form, the cord is wrapped once or twice about the shaft 24 on spool 22 as necessary and the initial reciprocating action to prime the engine and the unidirectional ripcord action to start the engine, all as previously discussed, can be intiated.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by U.S. Letters Patent is:

1. Engine priming and starting apparatus comprising:
a crankshaft,
an engine drivingly coupled to said crankshaft,
fuel supply means for supplying fuel to said engine,
a power take-off coupled to said crankshaft for taking power from said engine, and
means for priming and starting said engine including a diametrically enlarged cylindrical element drivingly coupled to said crankshaft intermediate said engine and said power take-off, and a cord having opposite free ends with an intermediate portion thereof wrapped at least once about said cylindrical element whereupon alternate pulling on the free ends of said cord causes rotation of said element and crankshaft in corresponding alternate angular directions to prime said engine solely by drawing fuel into said engine from said fuel supply means and subsequent release of one end of the cord and pulling its opposite end causes unidirectional rotation of said element and said crankshaft to start the engine utilizing fuel from said supply means, said cord being completely removed from said element when its opposite end is pulled to start said engine.

2. Apparatus according to claim 1 wherein said element comprises a spool.

3. Apparatus for priming an engine comprising:
a crankshaft,
an engine drivingly coupled to said crankshaft,
fuel supply means for supplying fuel to said engine,
a propeller drivingly coupled to said crankshaft,
means for priming said engine including a spool forming an integral portion of said propeller and projecting on the side of said propeller opposite said crankshaft, said spool having a free end remote from said propeller and a groove between said free end and said propeller, and a cord having opposite free ends with an intermediate portion thereof wrapped at least once about said spool whereupon alternate pulling on the free ends of said cord causes rotation of said spool, propeller and crankshaft in corresponding directions to prime said engine solely by drawing fuel into said engine from fuel supply means.

4. Apparatus according to claim 1 wherein said engine is a two-cycle engine adapted to draw fuel into the engine upon rotation of said crankshaft in each of said alternate angular directions.

5. Apparatus according to claim 3 wherein said engine is a two-cycle engine adapted to draw fuel into the engine upon rotation of said crankshaft in each of its angular directions.

6. A method for priming an engine having a cylindrical element drivingly coupled to the crankshaft of the engine comprising the steps of:
wrapping a cord about the cylindrical element at least one full turn leaving the opposite ends of the cord free,
alternately pulling the free ends of said cord to jointly rotate the element and crankshaft in corresponding alternate angular directions to prime said engine,
after priming, releasing one free end of the cord, and
pulling the opposite free end of the cord to rotate the element and the crankshaft unidirectionally to start the engine, the latter step of pulling including pulling the cord free of the cylindrical element.

* * * * *